US012389985B2

(12) United States Patent
Corcoran-Tadd

(10) Patent No.: US 12,389,985 B2
(45) Date of Patent: Aug. 19, 2025

(54) LACE ADJUSTMENT SYSTEM AND SHOE

(71) Applicant: adidas AG, Herzogenaurach (DE)

(72) Inventor: Fionn Corcoran-Tadd, Portland, OR (US)

(73) Assignee: adidas AG, Herzogenaurach (DE)

( * ) Notice: Subject to any disclaimer, the term of this patent is extended or adjusted under 35 U.S.C. 154(b) by 41 days.

(21) Appl. No.: 18/545,515

(22) Filed: Dec. 19, 2023

(65) Prior Publication Data

US 2025/0194752 A1 Jun. 19, 2025

(51) Int. Cl.
*A43C 1/00* (2006.01)

(52) U.S. Cl.
CPC ..... *A43C 1/003* (2013.01)

(58) Field of Classification Search
CPC .. A43C 1/003; A43C 7/00; A43C 7/04; A43C 7/08; A43C 11/20; A43C 1/00; A43C 11/08; A43C 3/00; A43C 11/06; Y10T 24/3732; Y10T 24/3734; Y10T 24/3742; Y10T 24/3774; Y10T 24/3768
See application file for complete search history.

(56) References Cited

U.S. PATENT DOCUMENTS

| | | | | |
|---|---|---|---|---|
| 5,129,130 | A * | 7/1992 | Lecouturier | A43C 7/00 24/713.2 |
| 6,327,750 | B1 * | 12/2001 | Muldowney | A43C 1/00 24/712.1 |
| 6,671,980 | B1 * | 1/2004 | Liu | A43C 11/008 24/712 |
| 6,757,991 | B2 | 7/2004 | Sussmann | |
| 11,510,462 | B2 | 11/2022 | Yun | |
| 11,602,196 | B2 | 3/2023 | Corcoran-Tadd | |
| 2019/0254384 | A1 * | 8/2019 | McCollister | A43C 1/00 |
| 2020/0138145 | A1 | 5/2020 | Greenspan et al. | |
| 2021/0093046 | A1 | 4/2021 | Lam et al. | |

* cited by examiner

*Primary Examiner* — Jack W Lavinder
(74) *Attorney, Agent, or Firm* — Brooks Kushman P.C.

(57) ABSTRACT

An article of footwear is provided with a lace adjustment device that provides bi-modal lace adjustment. A toggle body has a lace aperture positioned eccentrically. The toggle body rotates about the central axis to move between a first position and second position. In the second position, the at least one lace has a greater amount of tightness than when the toggle body is in the first position. The toggle body has a first surface and a second surface opposite the first surface, and the lace aperture is positioned adjacent the first surface. The toggle body rests on the first surface when in a first loose position, and when the toggle body is in a second tighter position, it rests on the second surface.

20 Claims, 6 Drawing Sheets

(1st POSITION-LOOSER)

(2nd POSITION-TIGHTER)

(1st POSITION)

(2nd POSITION)

LACE ADJUSTMENT SYSTEM AND SHOE

TECHNICAL FIELD

The present application relates to footwear with a lacing system and having an adjustment device for varying the tightness.

BACKGROUND

Athletic shoes and other footwear typically include an upper to support a foot and the sole structure. The uppers may have laces, or straps, cables or other fasteners, to adjust the fit of the upper around the foot. The laces may be tightened and tied to secure the upper around the user's foot.

Various tightening systems allow the uppers to be adjusted. Typically, these systems allow the tightness of the uppers to be opened to allow entry and removal of the user's foot, and then to incrementally increase the tightness to achieve the desired fit of the upper around the foot.

SUMMARY

In one or more embodiments, a lace adjustment device for footwear is provided. The lace adjustment device has a toggle body movable between two positions to provide bi-modal lace adjustment. The toggle body has a first surface and a second surface opposing the first surface where the toggle body is in a first position when resting on the first surface and is in a second position when resting on the second surface. A curved face extends between the first surface and second surface in a height direction. The curved faces has a complex contour defined by a first curvature adjacent the first surface, and a second curvature adjacent the second surface. A lace aperture extends through the toggle body for receiving at least one lace. A central axis of the aperture is eccentric relative to the first and second surfaces and is spaced apart in the length direction from the curved face. The toggle body rotates about the central axis of the aperture to move between the first and second position.

In one or more embodiments, the aperture is closer to the first surface of the toggle body than the second surface.

In one or more embodiments, the toggle body has a tab protruding opposite the curved face. The tab is configured for gripping the toggle body and to move between the first position and the second position. In one or more embodiments, the tab extends adjacent the second surface.

In one or more embodiments, the second surface has a second contact area being greater than a first contact area.

In one or more embodiments, the toggle body is formed of a first part being a first material and a second part formed of a second material being softer than the first material.

In one or more embodiments, an article of footwear is provided having a shoe upper having a first and second lace retention features. At least one lace extends between the first and second lace retention features. A toggle body provides bi-modal lace adjustment. The toggle body has a lace aperture extending through the toggle body for receiving the ace where a central axis of the aperture is positioned eccentrically. The toggle body rotates about the central axis to move between a first position and second position, where in the second position, the at least one lace has a greater amount of tightness than when the toggle body is in the first position. The toggle body has a first surface, and the lace aperture is positioned adjacent the first surface. A second surface is opposite the first surface on the toggle body. The toggle body rests on the first surface when in a first loose position, and when the toggle body is in a second tighter position, it rests on the second surface.

In one or more embodiments, the toggle body has a curved face extending between the first surface and second surface in a height direction. In one or more embodiments, the lace aperture is offset by a length dimension from a radial center of the curved surface.

In one or more embodiments, the curved face has a complex curvature defined by a first curvature positioned adjacent the first surface, and a second curvature positioned adjacent the second surface. In one or more embodiments, the lace aperture is offset by a length dimension from a radial center of the second curvature.

In one or more embodiments, the footwear has a reaction pad disposed on the shoe upper. The reaction pad has a surface for supporting the first and second surface of the of the toggle body In one or more embodiments, the reaction pad is positioned along at least one of a tongue, medial surface, lateral surface or heel of the shoe upper. In one or more embodiments, the reaction pad comprises a cushion layer to provide comfort.

In one or more embodiments, the footwear has a plurality of toggle bodies positioned at a plurality of locations along the at least one lace.

In one or more embodiments, the toggle body is formed of a flexible material so that a height of the toggle body may be compressed in the second tighter position to provide comfort.

In one or more embodiments, the at least one lace comprises a pair of laces and the aperture is sized for a pair of laces. The toggle body is positioned between the first and second lace retention features.

In one or more embodiments, a lace adjustment device for footwear is provided. The device has a toggle body movable between two positions to provide lace adjustment. The toggle body rests on a first surface when the toggle body is in a first position. The toggle body rests on a second surface opposite the first surface when the toggle body is in a second position. A curved face extends in a height direction between the first surface and second surface. The toggle body has an eccentric aperture extends through the toggle body for receiving at least one lace. The aperture is positioned eccentrically relative to the first and second surfaces and is spaced apart by a length dimension from a radial center of the curved face. The toggle body rotates about the central axis of the aperture while riding on the curved face to move between the first and second position to provide bi-modal adjustment of the toggle body.

In one or more embodiments, the curved face has a complex contour defined by a first curvature adjacent the first surface and a second curvature adjacent the second surface. The first curvature has a first radius being greater than a second radius of the second curvature. The aperture is spaced apart in the length dimension from at least one of a first radial center of the first curvature or a second radial center of the second curvature.

In one or more embodiments, the curved face has a complex contour defined by a first curvature adjacent the first surface and a second curvature adjacent the second surface, wherein the central axis of the aperture is spaced apart in the length direction from the second radial center of the second curvature, where the aperture is positioned closer to the first surface.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
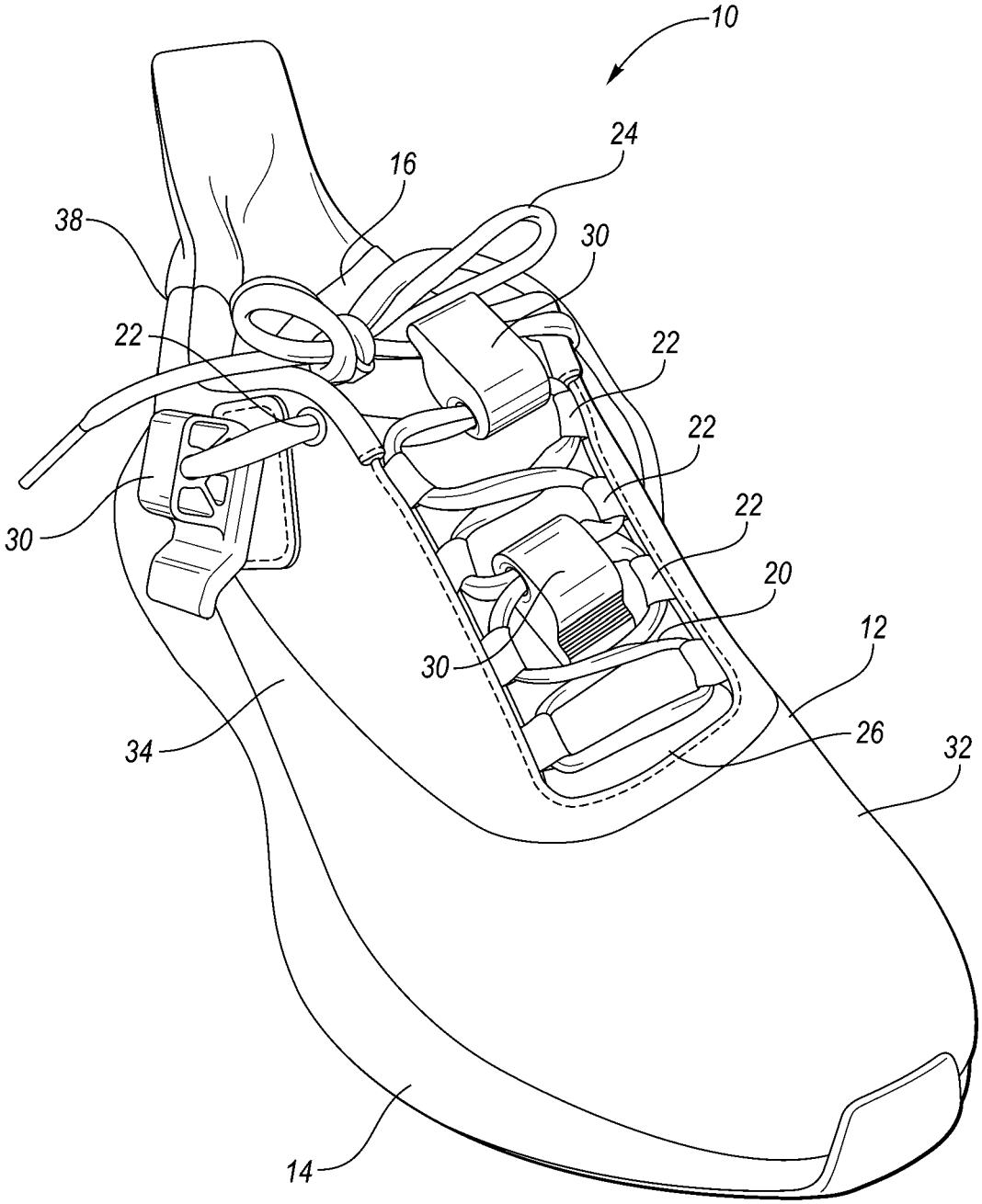
FIG. 1 illustrates a perspective view of a shoe using a lace adjustment system according to one embodiment.

FIG. 1 shows an article of footwear 10 as a running shoe having an upper 12 coupled to a sole 14. The upper 12 may be formed of one or more components that are stitched, bonded, or otherwise joined together to form a structure for receiving and securing a foot relative to sole structure 14. The sole structure 14 may include a midsole, an outsole and an insole or cushioning layer.

The shoe 10 includes a lacing system 20 for tightening a shoe upper. The lacing system 20 includes a plurality of retention features 22 for retaining the laces 24. As shown here, the retention features 22 may include a number of eyelets and loops arranged on opposing sides of a throat of the shoe upper, however, the lacing system 20 may have webbing, straps, hooks or any suitable retention features. The lace 24 is fed through the retention features 22 on the right and the left side of the throat to urge opposing sides of the throat towards each other and tighten the lace 24 to fasten the athletic shoe to the user's foot. The lacing system 20 allows the wearer of the shoe to tighten and loosen the shoe upper 12 by adjusting the laces 24 within the retention features 22.

Traditional lacing systems or other tightening systems can be infinitely adjusted. However, traditional lacing systems do not provide the opportunity to quickly make small adjustments mid sport. For example, in running, feet can swell and change volume throughout a race, such as a marathon. Being able to quickly ease the laces without undoing them could change the running experience.

In other sports, players are constantly being subbed in and out of the game, such as in basketball, soccer, or volleyball, or other sports. Being able to quickly switch to relax the fit of the shoe during breaks and then go back into game mode is an advantage. Other sports may want different fits for different stages. For example, in cycling, the user may want to switch to a different fit for flat versus uphill, or spinning versus sprinting. Athletic shoes used for training may benefit from different tightness during a varied workout, like interval training, where explosive movements require stability and tightness, but low impact movements could provide for a looser, more comfortable fit. The lacing system 20 with the adjustment device 30 provides a simple component that lets the user easily switch the fit of the laces mid activity without having to re-lace their shoes.

In addition to providing small adjustments, the lacing system 20 may provide for larger adjustments with multiple adjustment devices 30. The multiple adjustment devices 30 could be used to provide a large amount of loosening or tightening of the shoe for taking it on and off, for example. As shown in FIG. 1 for example, three adjustment devices 30 may be position along the throat of the shoe so that switching all three devices can be simultaneously moved to a loose position to allow a user to put the shoe on. Then simply flipping the devices 30 to a tight position allows the user to fully tighten the shoe.

As shown in FIG. 1, the adjustment device 30 can be placed where the laces cross along the throat 26 of the shoe. The adjustment device 30 may also be positioned on the medial side 32, lateral side 34 or tongue 36 or heel 38 of the upper 12. The adjustment device 30 may also be placed anywhere along the laces 24 between two retention features 22, such as eyelets.

The adjustment device 30 is shaped to be a bistable mechanism that provides quick and simple lace adjustment between only two preset positions. The adjustment device 30 is also able to be added to any traditional lacing system.

Figure 2:
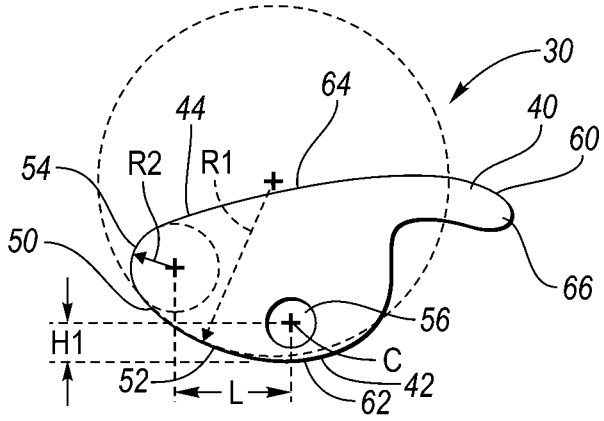
FIG. 2 is a side view of a lace adjustment device in a first position according to one embodiment.
Figure 3:
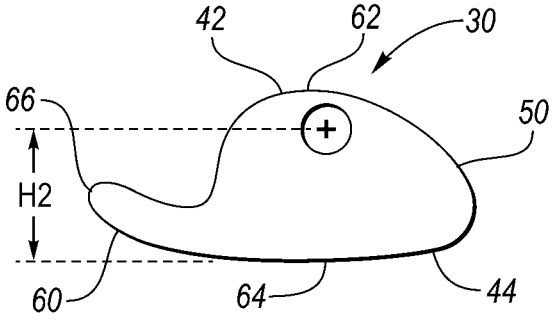
FIG. 3 is a side view of the lace adjustment device in FIG. 2 shown in a second position.

As shown in more detail in FIGS. 2-5, the lace adjustment device 30 is formed of a toggle body 40 according to a first embodiment. The toggle body 40 is movable between two positions to provide bi-modal lace adjustment. The toggle body 40 has a first surface 42 and a second surface 44 opposite the first surface 42. In FIG. 2, the toggle body 40 is in a first position when resting on the first surface 42. The toggle body 40 is in a second position when resting on the second surface 44.

Figure 4:
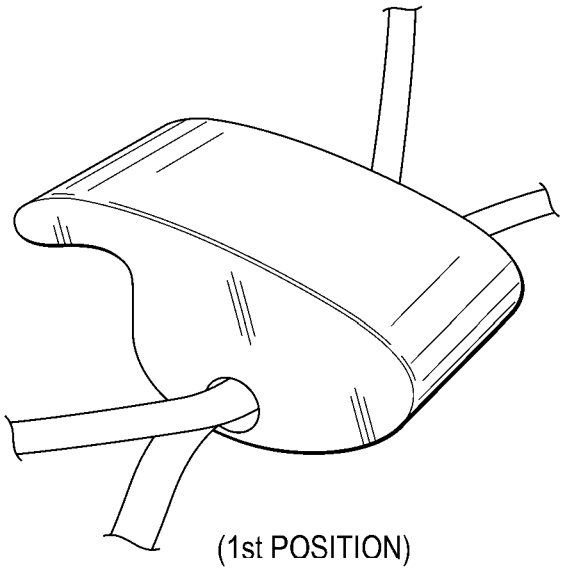
FIG. 4 is a perspective view of the lace adjustment device in FIG. 2 shown in use in the first position with a pair of laces.
Figure 5:
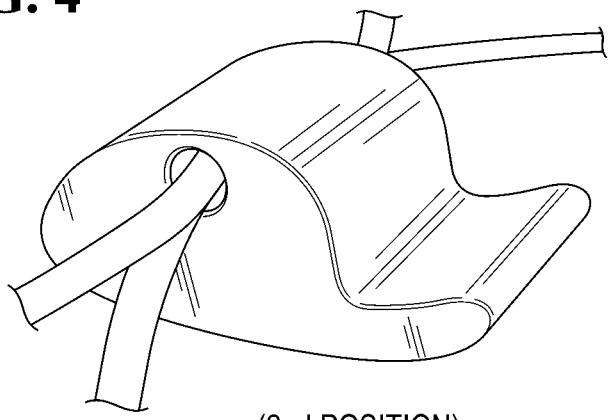
FIG. 5 is a perspective view of the lace adjustment device in FIG. 2 shown in use in the second position with a pair of laces.
Figure 6:
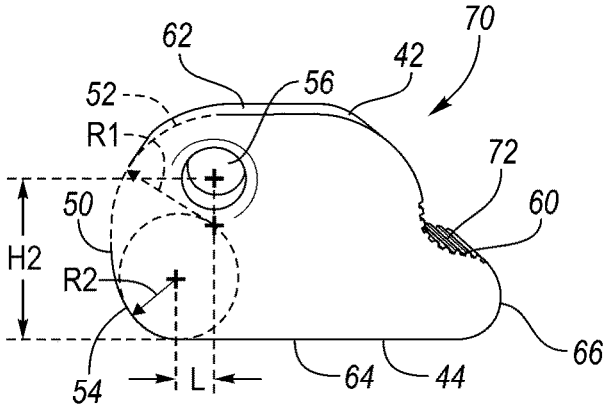
FIG. 6 is a side view of a lace adjustment device according to another embodiment.

FIGS. 4-5 illustrate the toggle body 40 cooperating with a pair of laces 24. In FIG. 4, the toggle body 40 rests on the first surface 42 and is in the first position. In FIG. 5, the toggle body 40 rests on the second surface 44 and is in the second position.

The toggle body 40 has a curved face 50 extending between the first surface 42 and second surface 44 in a height direction. The complex contour of the curved face 50 is defined by a first curvature 52 and a second curvature 54. The first curvature 52 has a first radius R1 being greater than a second radius R2 of the second curvature 54.

The toggle body 40 has an aperture 56 extending through the toggle body 40 for receiving at least one lace 24. The aperture 56 is eccentric relative to the first and second surfaces 42, 44 and is spaced apart in the length direction by a length L from the radial center of the second curvature 54 by a length dimension that is greater than zero. In the embodiment shown in FIGS. 2-5, the aperture 56 is closer to the first surface 42 and the first curvature of the toggle body than the second surface 44.

The toggle body 40 rotates about off-center axis C of the aperture 56 to move between the first position and second position. In the first position, the axis C of the aperture 56 is positioned at a first height H1. In the second position, the axis C of the aperture 56 is positioned at a second height H2. H1 may be generally 1 mm to 5 mm, for example. H2 may be generally 1.5 mm to 35 mm depending. H1 and H2 may vary based on the desired change in tightness. The greater height H2 provides additional tightness in position two, while the lower height H1 provides a first position that is looser.

The aperture 56 is closer to the first surface 42 of the toggle body 40 than the second surface 44. The complex contour of the curved face 50 is defined by a first curvature 52 adjacent the first surface 42 and a second curvature 54 adjacent the second surface 44. This geometry makes the toggle body 40 stable in both the first position and second position. In particular, in the tighter second position, the tighter second curvature 54 and the location of the aperture 56 ensure the toggle body 40 is maintained in the tighter second position even while the shoe is in use and experiencing forces and vibrations, such as while the wearer is running. The geometry also ensures that the toggle body 40 would not move from the looser first position to the second position without the user intentionally applying force to switch the toggle body 40.

The toggle body 40 also has stability in the second position based on the location of the lace aperture 56 relative to the second curvature 54. The center of the lace aperture 56 is always inboard from center of second radius R2 the curved surface 50. This provides ensures that the toggle body 40 remains in the second position because the aperture 56 is over-center relative to the radius R2 of the second curvature 54. Once the toggle body 40 is moved to the second tight position that is over-center, the toggle body 40 cannot be moved or unlocked unless a certain amount of force is used to pull the toggle body over the second curvature 54. Therefore, the center C of the lace aperture 56 is overset inboard from the center of the radius R2 by the distance L, which is always greater than zero.

The second surface 44 also has a second contact area 64 being greater than a first contact area 62. The greater contact area 64 of the second surface 44 also helps ensure the toggle body 40 remains in the second position. The greater contact area 64 may also spread out the force being applied to the wearer on the high-pressure side of the toggle body 40.

The toggle body 40 also has a tab 60 protruding opposite the curved face 50. The tab 60 allows a wearer to easily grip the toggle body 40 and to move between the first position and the second position. As shown in FIGS. 2-5, the tab 60 extends continuously from the second surface 44. A distal end 66 of the tab 60 may be offset toward the first surface 42 from a contact area 64 in the second position. The offset distal end 66 allows the tab 60 to be easily gripped, even when the toggle body 40 is in the second position.

Figure 7:
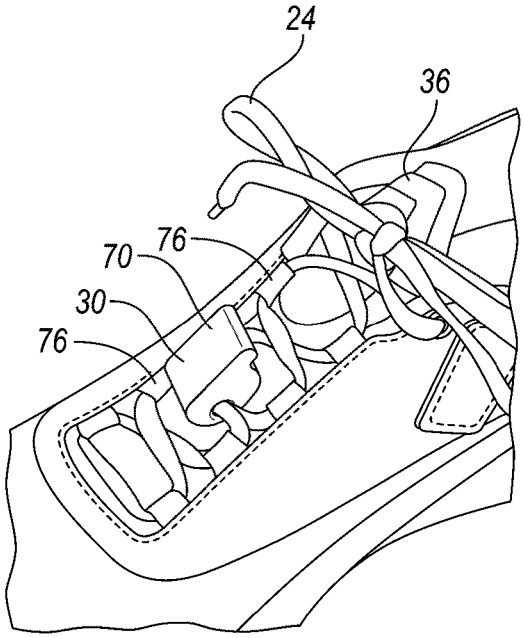
FIG. 7 illustrates a perspective view of a portion of a shoe with the lace adjustment device of FIG. 6 shown holding the laces in a looser position.
Figure 8:
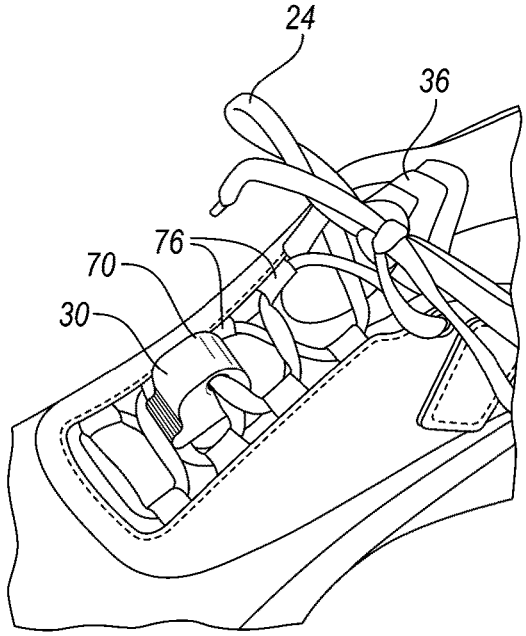
FIG. 8 is a perspective view of a portion of a shoe with the lace adjustment device of FIG. 6 shown holding the laces in a tighter position.

FIGS. 6-9 illustrate an adjustment device 30 having a toggle body 70 according to another embodiment. In FIGS. 7-8, illustrated is the toggle body 70 installed on a pair of laces 24 and is positioned between the retention features 22 and positioned above the tongue 36. The toggle body 70 cooperates with a reaction pad 76 positioned on the tongue 16. In FIG. 7, the toggle body 70 is in a first position when resting on the first surface 42. In FIG. 8, the toggle body 70 is in a second position when resting on the second surface 44.

The toggle body 70 has an overall different shape and contour but has similar features and functions. The toggle body 70 has a curved face 50 extending between the first surface 42 and second surface 44. The complex contour of the curved face 50 is defined by a first curvature 52 and a second curvature 54. The first curvature 52 has a first radius R1 being greater than a second radius R2 of the second curvature 54.

The aperture 56 is eccentric relative to the first and second surfaces 42, 44. The aperture is offset inboard in the length direction by the length dimension L from the center of the second curvature 54. In FIGS. 6-9, the aperture 56 is closer to the first surface 42 and the first curvature 52 of the toggle body 70 than the second surface 44.

The toggle body 70 rotates about the central axis C of the aperture 56 to move between the first position and second position. In the second position, the central axis C of the aperture 56 is positioned at a second height H2 to provide additional tightness.

The toggle body 70 also has a tab 60 protruding opposite the curved face 50. The tab 60 allows a wearer to easily grip the toggle body 70 and to move between the first position and the second position. As shown in FIGS. 6-9, the tab 60 extends generally straight in the same general plane as the second surface 44. The tab 60 includes a textured grip portion 72 formed opposite the second surface. The grip portion 72 has ridges that helps the tab 60 to be easily gripped by a user. The grip portion 72 may have any pattern or shaped textured surface. The grip portion 72 may be such as on the second surface 44 or on the outer sides, for example. The grip portion 72 may be placed on any suitable surface of the toggle body.

The second surface 44 also has a second contact area 64 being greater than a first contact area 62. As shown in FIGS. 6-9, the contact area 64 is generally planar and extends from the curved face 50 and along the tab 60.

Figure 9:
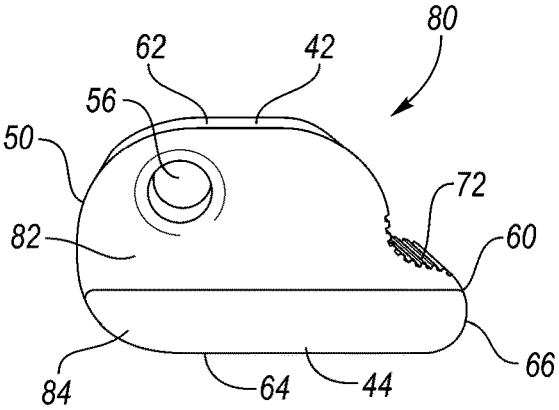
FIG. 9 is a side view of a lace adjustment device according to another embodiment.
Figure 10:
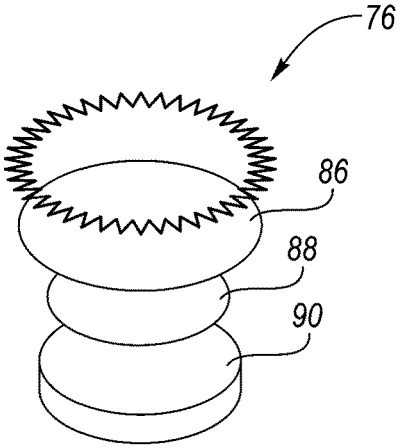
FIG. 10 illustrates an exploded view of a portion of a lace adjustment system.
Figure 11:
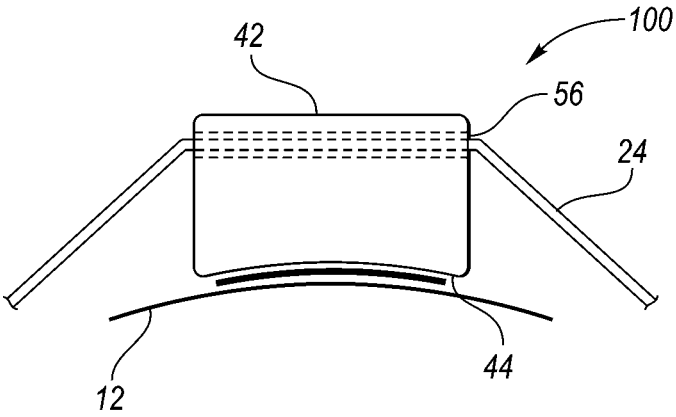
FIG. 11 is an end view of a lace adjustment device according to one embodiment.

FIGS. 9-11 illustrate additional features that help provide comfort to the wearer when the toggle is in the tighter second position. In FIG. 9, a toggle body 80 is shown having two parts. The first part 82 forms the upper portion of the toggle body 80 and may be formed of a harder material than the second part 84. The second part 84 may be formed of a softer material to provide some cushioning or allow the second surface 44 to conform to the shoe or the user's foot or distribute and soften potential pressure points. The toggle body 80 may be molded together as a dual injection part with two materials, or the parts may be molded separately and joined together. The first part 82 may be molded of a stiff structural material while the second part 84 may be formed of a softer material. For example, the first part 82 may be formed of stiff materials such as nylon, TPU, fiberglass re-enforced polyamide, ABS, Carbon fiber-reinforced polymers, Acrylic, Polypropylene, Polyoxymethylene (POM), Polycarbonate, or other suitable stiff materials. The second part 84 may be formed of soft materials such as softer compound TPU, foam, rubber silicone, or other suitable materials that are softer and provide more cushion than the first part 82.

FIG. 10 shows an exploded view of the reaction pad 76 that provides cushioning when the toggle body is in the second, tighter position. The reaction pad 76 may have an outer appearance layer 86, reaction layer 88 and a cushion layer 90. The reaction pad 76 may be circular, rectangular, or any suitable shape. The reaction layer 88 may be stiff sheet that resists deformation the adjustment device 30 applies force, especially in the second tighter position. The reaction layer may be a chem sheet, or formed of other materials such as nylon, TPU, non-woven fiber board, cellulose board or other suitable sheet or board material with sufficient stiffness. The appearance layer 86 may be formed of suede, or synthetic suede, or any suitable material. The cushion layer 90 may be formed of foam, such as 5 millimeter foam, or sockliner foam, or any suitable foam or cushion material. The layers of the reaction pad may be stitched to the upper 12 along the medial side 32, the lateral side 34 or the tongue 36, as shown in FIG. 1, or positioned at any suitable location on the shoe.

FIG. 11 shows an end view of a toggle body 100 according to another embodiment shown in the tighter second position. The second surface 44 may have a curvature to match a curvature of the upper 12 or the wearer's foot.

Figure 12:
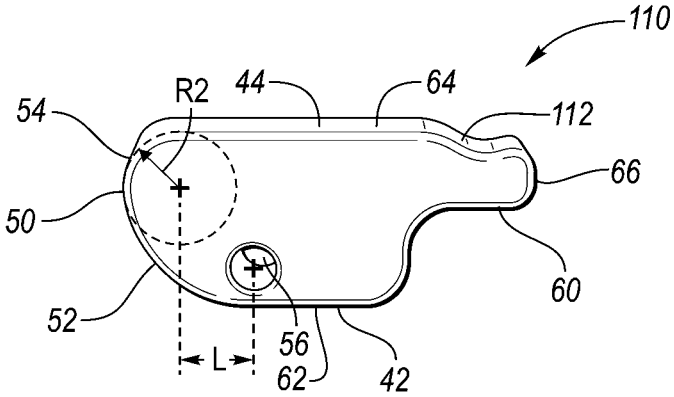
FIG. 12 is a side view of a lace adjustment device according to another embodiment.

FIG. 12 is a toggle body 110 according to another embodiment shown in the looser first position. The toggle body 110 has an overall different shape and contour, but has similar features and functions as discussed above. The toggle body 110 has a curved face 50 extending between the first surface 42 and second surface 44. The complex contour of the curved face 50 is defined by a first curvature 52 and a second curvature 54. The first curvature 52 has a first radius R1 being greater than a second radius R2 of the second curvature 54.

The toggle body 110 has an aperture 56 is positioned at a first height H1. In the second position, the central axis C of the aperture 56 is positioned at a second height H2. The greater height H2 provides additional tightness in position two, while the lower height H1 provides a first position that is looser.

The toggle body 110 also has a tab 60 protruding opposite the curved face 50. The tab 60 has a step contour 112 so that the distal end 66 of the tab 60 is offset toward the first surface 42. The offset distal end 66 allows the tab 60 to be easily gripped, even when the toggle body 110 is in the second position.

Figure 13:
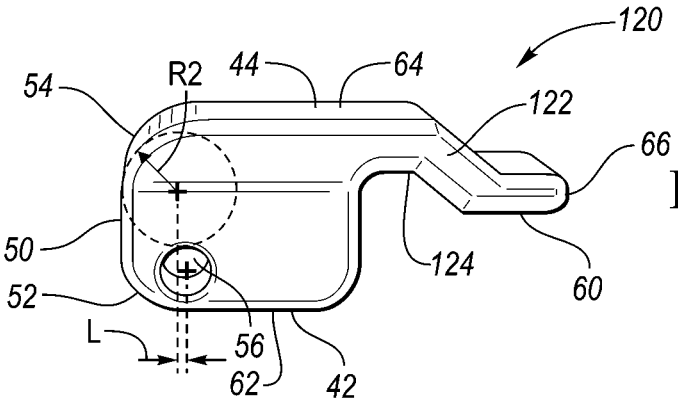
FIG. 13 is a side view of a lace adjustment device according to another embodiment.

FIG. 13 is a toggle body 120 according to another embodiment shown in the looser first position. The toggle body 120 has an overall different shape and contour, but has similar features and functions as discussed above. The toggle body 120 has a curved face 50 extending between the first surface 42 and second surface 44. The complex contour of the curved face 50 is defined by a first curvature 52 and a second curvature 54. The first curvature 52 has a first radius R1 being less than a second radius R2 of the second curvature 54. The aperture 56 is positioned generally at the center of the radius of curvature of R1.

The toggle body 120 has an aperture 56 positioned at a first height H1. In the second position, the central axis C of the aperture 56 may be positioned at a second height H2 to provide increased tightness.

The toggle body 120 also has a tab 60 protruding opposite the curved face 50. The tab 60 has an angled segment 122 so that the distal end 66 of the tab 60 offset between the first surface 42 and the second surface 44. A grip notch 124 is also defined along the tab 60.

Figure 14:
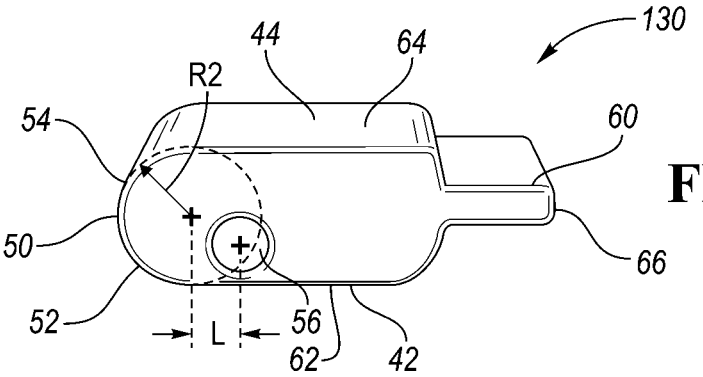
FIG. 14 is a side view of a lace adjustment device according to another embodiment.
Figure 15:
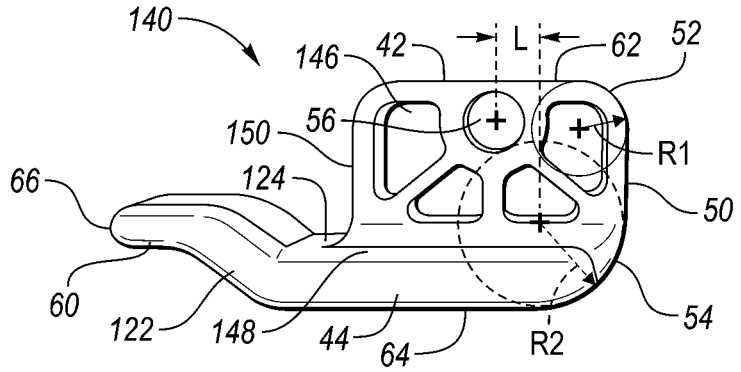
FIG. 15 is a side view of a lace adjustment device according to another embodiment.

FIG. 14 is a toggle body 130 according to another embodiment, shown in the looser first position. The toggle body 130 has an overall different shape and contour, but has similar features and functions as discussed above. The toggle body 130 has a curved face 50 extending between the first surface 42 and second surface 44. In the embodiment of FIG. 14, the contour of the curved face 50 is defined by a single curvature R2. The aperture 56 is offset by a length dimension L from R2.

The toggle body 130 has an aperture 56 positioned at a first height H1. In the second position, the central axis C of the aperture 56 may be positioned at a second height H2.

The toggle body 130 also has a tab 60 protruding opposite the curved face 50. The tab 60 extends linearly from a position between the first and second surface 42, 44.

Figure 16:
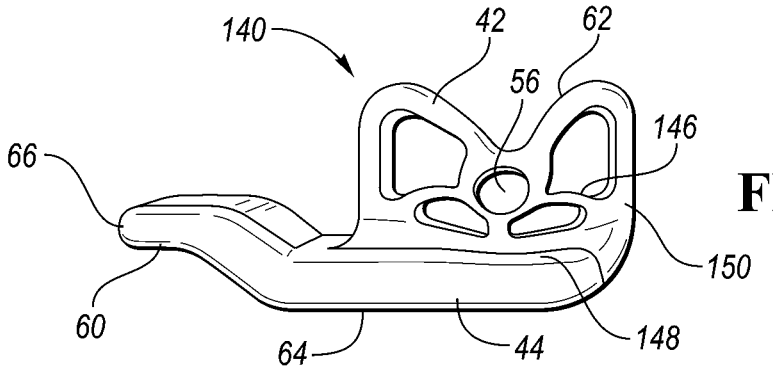
FIG. 16 is a side view of the lace adjustment device in FIG. 15 shown in a compressed state.
Figure 17:
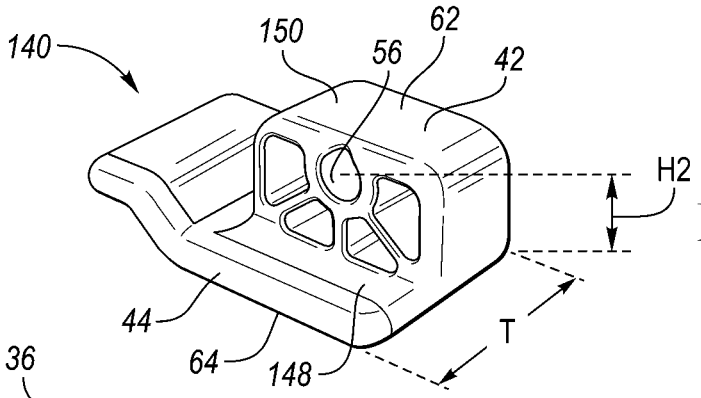
FIG. 17 is a perspective view of the lace adjustment device in FIG. 15
Figure 18:
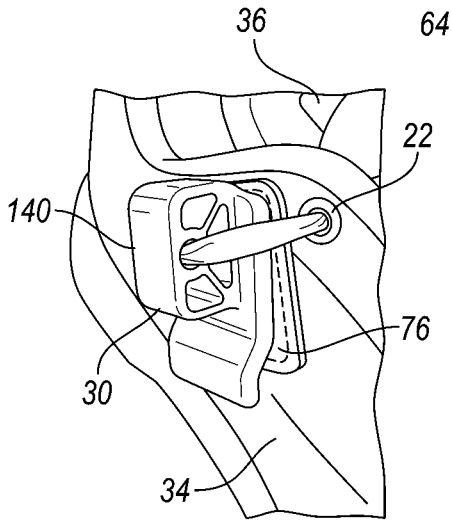
FIG. 18 illustrates a portion of a shoe with the lace adjustment device of FIG. 15 shown holding the laces in a tighter position.
Figure 19:
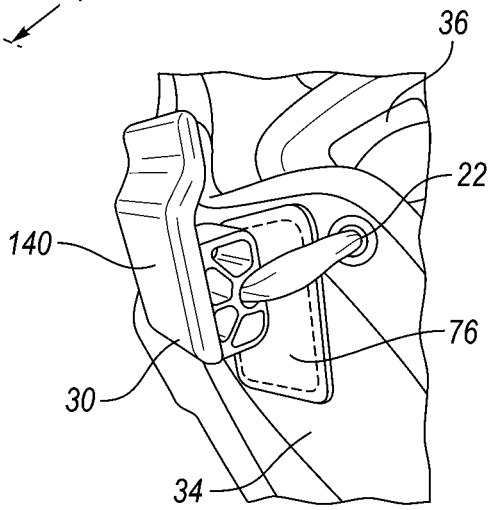
FIG. 19 illustrates a portion of a shoe with the lace adjustment device of FIG. 15 shown holding the laces in a looser position.

FIGS. 15-19 illustrate an adjustment device 30 having a toggle body 140 according to another embodiment. In FIGS. 18-19, the toggle body 140 is installed on one lace 24 and is positioned between retention features 22 and is positioned along the lateral side 34 of the upper. The toggle body 140 cooperates with a reaction pad 76 fixed to the lateral side 34. In FIG. 19, the toggle body 140 is in a first position resting on the first surface 42. In FIG. 18, the toggle body 140 is in a second position resting on the second surface 44.

The toggle body 140 also has a second surface 44 having an increased contact area 64 along the second surface 44. As shown in FIG. 17, the toggle body 140 has a flange 148 extending with an increased thickness T. The flange 148 has an increased thickness T relative to the main body 150. The aperture 56. Extends through the main body 150 for receiving the lace 24. The aperture 56 is eccentric relative to the first and second surfaces 42, 44. The flange 148 provides the increased contact area 64 when the toggle body 140 is in the second position, but does not significantly increase the size and weight of the toggle body 140.

The toggle body 140 has a curved face 50 extending between the first surface 42 and second surface 44. The complex contour of the curved face 50 is defined by a first curvature 52 and a second curvature 54. The first curvature 52 has a first radius R1 being less than a second radius R2 of the second curvature 54. As shown, the first curvature 52 is adjacent the first surface 42. The aperture 56 is spaced apart in the length direction by the length L from the center of the first curvature 52 at least by the tighter radius R1.

The toggle body 140 rotates about the central axis C of the aperture 56 to move between the first position and second position. In the second position, the central axis C of the aperture 56 is positioned at a second height H2 to provide additional tightness.

As shown in FIGS. 15-19, the toggle body 140 has a web 146 of openings. The web 146 may include a plurality of openings that extend through the toggle body 140. The web 146 may also have other elements such as reduced thickness that allows for controlled compliance built into lacing pressure. The toggle body 140 may be formed of an elastomer that allows the web 146 to compress and have a spring-effect. The web 146 provides a low level of controlled sprung fit and stretch to the lacing system 20. As shown in FIG. 16, the web 146 may be compressed when the toggle body 140 experiences additional load when the toggle body 140 is in the second position. For example, the wearer may flex, rotate or tilt their foot during dynamic movements the web 146 could flex to provide more comfort and alleviate any pressure points caused by the toggle body 140.

The toggle body 140 also has a tab 60 protruding opposite the curved face 50. The tab 60 may also have the increased thickness T to provide additional grip for the used. The tab 60 has an angled segment 122 so that the distal end 66 of the tab 60 offset between the first surface 42 and the second surface 44. A grip notch 124 is also defined along the tab 60.

Figure 20:
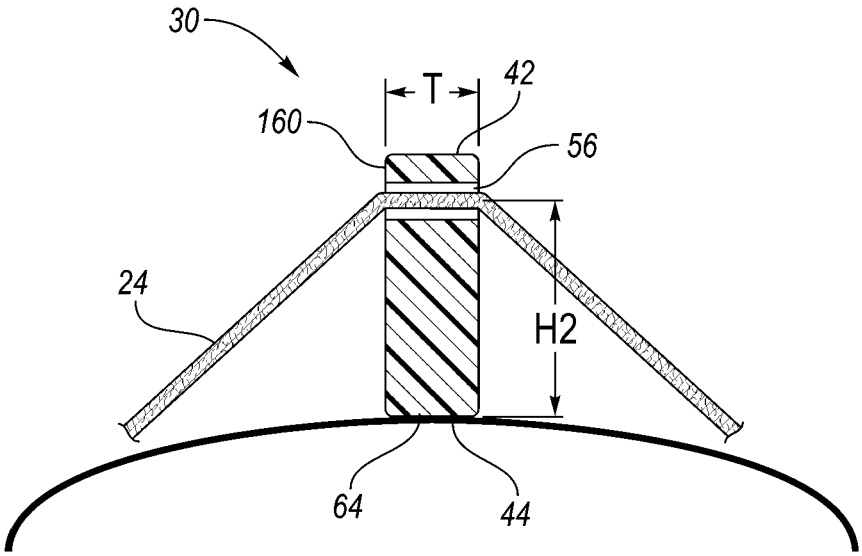
FIG. 20 is a cross section view of a lace adjustment device according to another embodiment.
Figure 21:
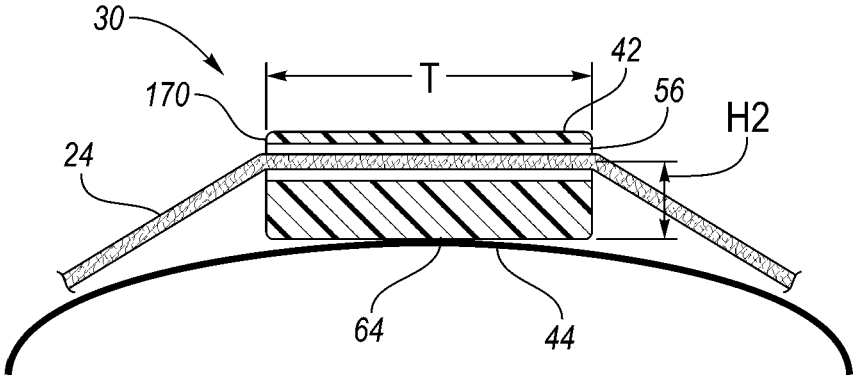
FIG. 21 is a cross section view of a lace adjustment device according to another embodiment.

FIGS. 20-21 show end-views of a lace adjustment devices 30 according to other embodiments. The adjustment device 30 may have various heights H2 measured from the second surface 44 to the center C of the lace aperture 56. The adjustment device 30 may also have various thicknesses T. Adjustment devices with heights H2 and the thicknesses T may be provided for different applications, different footwear dimensions or different amounts of tightness adjustment. For example, as shown in FIG. 20, a toggle body 160 may have a height H2 that is greater than the thickness T. FIG. 21 illustrates another example of a toggle body 170 where the height H2 is less than the thickness T. The toggle body 170 in FIG. 21 may provide similar tightness adjustment as the toggle body 160 in FIG. 20. However, the increased thickness T of toggle body 170 provides greater pressure distribution across the larger contact area 64. In contrast, toggle body 160 may be able to be positioned along small areas of the shoe that could not accommodate a larger adjustment device.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A lace adjustment device for footwear, the device comprising:

a toggle body movable between two positions to provide bi-modal lace adjustment, the toggle body comprising:

a first surface, wherein the toggle body is in a first position when resting on the first surface;

a second surface opposing the first surface, wherein the toggle body is in a second position when resting on the second surface;

a curved face extending between the first surface and second surface in a height direction, and having a complex contour defined by a first curvature adjacent the first surface, and a second curvature adjacent the second surface; and an aperture extending through the toggle body for receiving at least one lace, wherein a central axis of the aperture is eccentric relative to the first and second surfaces and is spaced apart in the length direction from the curved face, wherein the toggle body rotates about the central axis of the aperture to move between the first and second position.

2. The lace adjustment device of claim 1, wherein the aperture is closer to the first surface of the toggle body than the second surface.

3. The lace adjustment device of claim 1, wherein the toggle body further comprises a tab protruding opposite the curved face, the tab configured for gripping the toggle body and to move between the first position and the second position.

4. The lace adjustment device of claim 3, wherein the tab extends adjacent the second surface.

5. The lace adjustment device of claim 1, wherein the second surface has a second contact area being greater than a first contact area.

6. The lace adjustment device of claim 1, wherein the toggle body is formed of a first part formed of a first material and a second part formed of a second material being softer than the first material.

7. An article of footwear comprising:

a shoe upper having a first lace retention feature and a second lace retention feature, at least one lace extending between the first and second lace retention features;

a toggle body to provide bi-modal lace adjustment, the toggle body comprising:

a lace aperture extending through the toggle body for receiving the at least one lace, wherein a central axis of the aperture is positioned eccentrically;

a first surface, wherein the toggle body is in a first loose position when resting on the first surface, wherein the lace aperture is adjacent the first surface; and a second surface opposite the first surface, wherein the toggle body is in a second tighter position when resting on the second surface, wherein the toggle body rotates about the central axis to move between the first and second position wherein in the second position, the at least one lace has a greater amount of tightness than when the toggle body is in the first position.

8. The article of footwear of claim 7, wherein the toggle body has a curved face extending between the first surface and second surface in a height direction.

9. The article of footwear of claim 8, wherein the lace aperture is offset by a length dimension from a radial center of the curved face.

10. The article of footwear of claim 8, wherein curved face has a complex curvature defined by a first curvature positioned adjacent the first surface, and a second curvature positioned adjacent the second surface.

11. The article of footwear of claim 10, wherein the lace aperture is offset by a length dimension from a radial center of the second curvature.

12. The article of footwear of claim 7, further comprising a reaction pad disposed on the shoe upper, the reaction pad having a surface for supporting the first and second surface of the of the toggle body.

13. The article of footwear of claim 12, wherein the reaction pad is positioned along at least one of a tongue, medial surface, lateral surface or heel of the shoe upper.

14. The article of footwear of claim 12, wherein the reaction pad comprises a cushion layer to provide comfort.

15. The article of footwear of claim 12, further comprising a plurality of toggle bodies positioned at a plurality of locations along the at least one lace.

16. The article of footwear of claim 12, wherein the toggle body is formed of a flexible material so that a height of the toggle body may be compressed in the second tighter position to provide comfort.

17. The article of footwear of claim 7, wherein the at least one lace comprises a pair of laces, wherein the aperture is sized for a pair of laces, wherein the toggle body is positioned between the first and second lace retention features.

18. A lace adjustment device for footwear, the device comprising:

a toggle body movable between two positions to provide lace adjustment, the toggle body comprising:

a first surface, wherein the toggle body is in a first position when resting on the first surface;

a second surface opposite the first surface, wherein the toggle body is in a second position when resting on the second surface;

an aperture extending through the toggle body for receiving at least one lace, wherein a central axis of the aperture is eccentric relative to the first and second surfaces; and a curved face extending between the first surface and second surface in a height direction, wherein the aperture is spaced apart in a length dimension from a radial center of the curved face, wherein the toggle body rotates about the central axis of the aperture while riding on the curved face to move between the first and second position to provide bimodal adjustment of the toggle body.

19. The lace adjustment device of claim 18, wherein the curved face has a complex contour defined by a first curvature adjacent the first surface and a second curvature adjacent the second surface, wherein the first curvature has a first radius being greater than a second radius of the second curvature, wherein the aperture is spaced apart in the length dimension from at least one of a first radial center of the first curvature or a second radial center of the second curvature.

20. The lace adjustment device of claim 19, wherein the curved face has a complex contour defined by a first curvature adjacent the first surface and a second curvature adjacent the second surface, wherein the central axis of the aperture is spaced apart in the length direction from the second radial center of the second curvature; and wherein the aperture is positioned closer to the first surface.

* * * * *